US005177914A

United States Patent [19]

Hilmer

[11] Patent Number: 5,177,914

[45] Date of Patent: Jan. 12, 1993

[54] VERTICAL SECTION BUILDING CONSTRUCTION

[76] Inventor: Elwyn P. Hilmer, P.O. Box 68, Silvana, Wash. 98287

[21] Appl. No.: 664,470

[22] Filed: Mar. 1, 1991

Related U.S. Application Data

[63] Continuation-in-part of Ser. No. 369,028, Jun. 19, 1989, abandoned.

[51] Int. Cl.[5] ..... E04H 1/00

[52] U.S. Cl. ..... 52/79.9; 52/745.2; 411/383

[58] Field of Search ..... 52/79.1, 79.7, 79.8, 52/79.9, 745; 411/383, 384, 395

[56] References Cited

U.S. PATENT DOCUMENTS

| | | | |
|---|---|---|---|
| 414,976 | 11/1889 | Harvey | 52/79.7 |
| 1,229,477 | 6/1917 | Kramer | 52/79.7 |
| 2,287,229 | 6/1942 | Carpenter | 52/79.9 |
| 2,751,635 | 6/1956 | Donahue | 52/79.7 |
| 3,156,018 | 11/1964 | Slayter | 52/79.7 |
| 3,500,596 | 3/1970 | Andersson | 52/79.7 |
| 3,553,923 | 1/1971 | Pompas | 52/228 |
| 3,785,095 | 1/1974 | Verner | 52/745 |
| 3,871,146 | 3/1975 | Hamy | 52/79.7 |
| 3,898,799 | 8/1975 | Tracy | 52/227 |
| 3,940,902 | 3/1976 | Reale | 52/745 |
| 4,011,697 | 3/1977 | Fedolfi | 52/745 |
| 4,253,509 | 3/1981 | Collet | 411/383 |

FOREIGN PATENT DOCUMENTS

| | | | |
|---|---|---|---|
| 68111 | 3/1943 | Denmark | 52/79.7 |
| 2088508 | 6/1982 | United Kingdom | 411/395 |

*Primary Examiner*—Henry E. Raduazo

[57] ABSTRACT

Sections including floor(s), roof and sidewalls are tilted vertically to an upright position in series. Sections or segments are made up from floor, roof and sidewall subsections or panels assembled in a horizontal orientation, offering easy access to install ground floor insulation, finish walls, ceilings and floors before being tilted up to a permanent position such that interfacing edges to be joined are in a vertical plane. Floor, roof, sidewall and end wall subsections or panels are fabricated in flat configuration for forklift unit stacking, storage and handling. The primary application, permanent or temporary, can be for finished domestic housing or outbuildings, or an unfinished shell. A special sequence fastener having three basic parts holds together subsection parts to be raised as a section, slides raised section in place and anchors sections to the structures foundation at the ground level. Interrupted wall and roof offset construction allows daylight and side entrance access for good traffic circulation and to avoids the "tunnel" house.

4 Claims, 7 Drawing Sheets

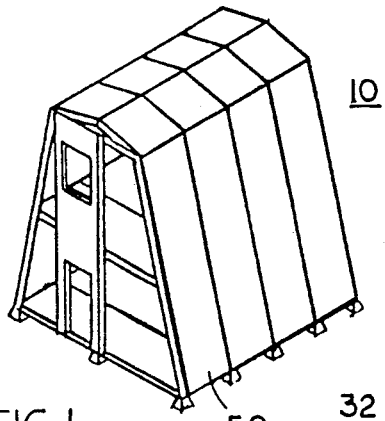
FIG. 1
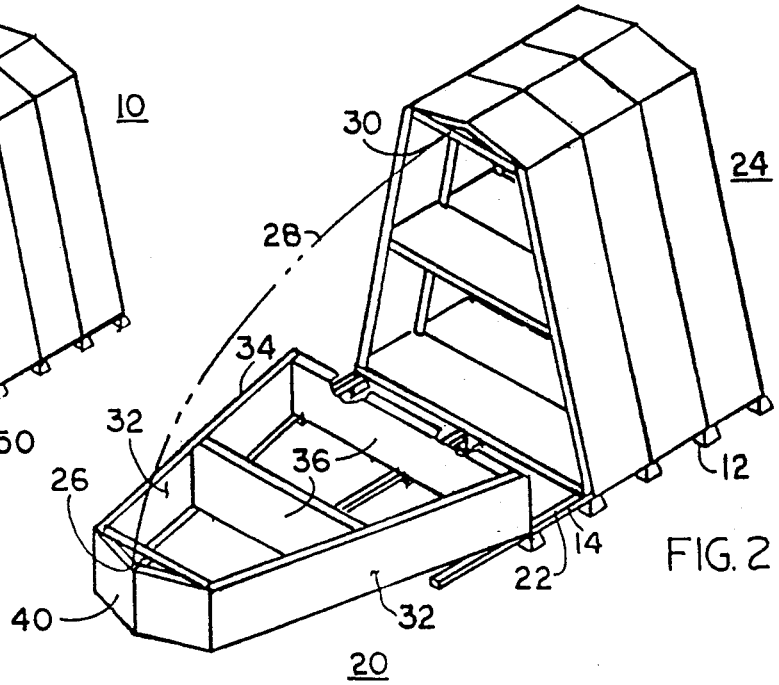
FIG. 2
FIG. 15
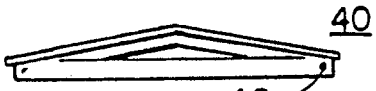
FIG. 16
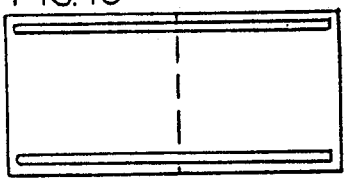
FIG. 17
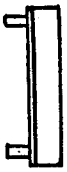
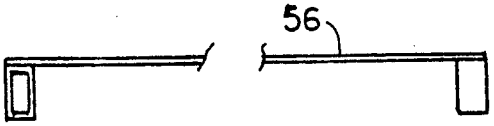
FIG. 12A
FIG. 9
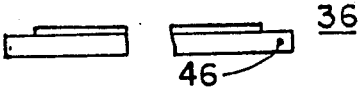
FIG. 12
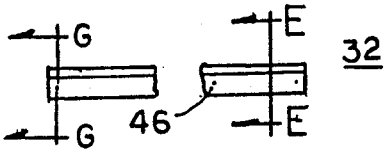
FIG. 10
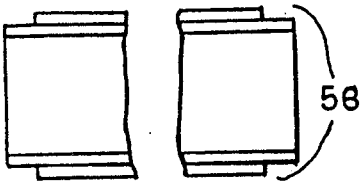
FIG. 11
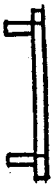
FIG. 13
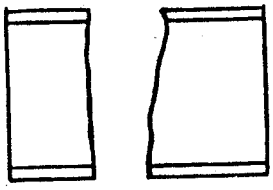
FIG. 14
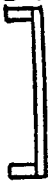

46

46

40
A
C
B

C
46
C 58
36
A
C
B

46
D
D

32
B
C
A 62
44
46

VERTICAL SECTION BUILDING CONSTRUCTION

This application is a Continuation In Part of my application entitled "Vertical Section Building Construction" Ser. No. 369,028, filed Jun. 19, 1989, now abandoned.

The present invention relates to buildings and pertains more specifically to a more efficient structural design and method of construction.

It has been the practice to "stick" build homes and outbuildings, one piece at a time. This is expensive and time consuming. Modular mobile homes are factory assembled and moved to a site over the highways presenting a road hazard. Their mobility also presents design and structural size limitations.

Past art "Barn raisings", a common term, implies that entire wall or frame sections are pieced together lying flat on the ground adjacent to permanent position placement and when completed are raised to a vertical position by a group of people and/or with the aid of a hoist.

Other prior art portable type dwellings are constructed of wood, plastic or fiberglass and are obviously temporary structures. In most cases, these buildings are set on a temporary foundation and the floor decking is one piece after nailing.

I have developed and constructed a dwelling using dimension lumber and standard plywood sheets that avoids "stick" construction methods that by design also takes less time to construct. Narrow subsection floors, sidewalls and roof are assembled in a horizontal orientation in their appropriate positions, then raised 90° to a self standing position for the first section or segment and, then in series subsequently other sections or segments are "raised" and moved together to join tongue and groove plywood panels. Each raised section or segment is securely bolted to the standing prior raised section at the interface.

With all the parts, subsections, materials at hand, vertical section shell construction of a building can be completed in one day's time.

The structure may have vertical or slanted walls, a flat or pitched roof.

Distinctive advantages with this method of building construction are: Ground floor insulation installation is readily accessible when a vertical section is lying on its side. Construction assembly and erection of building, one or two or more stories, is accomplished at ground level as a worker safety measure. After raising each vertical section or segment fastening the sections or segments together can be accomplished from within the building's interior and at ground level as a worker safety measure.

Other advantages are: interior finish could be conventional dry wall (code), or portable inset insulation-wall board construction; permanent or harness wiring; and permanent custom fitted vinyl(type) tarp roofing. Portable disassembly reverses the erection procedure. Permanent-portable structural integrity is then provided by the vertical oriented sectional parts. Each floor in the structure can be a "great room" on a small scale. An example shown in the drawings with vertical tapered-in walls reduces floor-ceiling and roof support span and stabilizes the building's structural integrity. The large scale structure of this particular design would include support gussets according to engineering specifications. Endwalls, windows, eaves, facia, decks, add-ons can be incorporated on site.

A single fastening means is provided for a three step assembly. This one integrated sequence fastener has three basic parts, a female bolt part, a male bolt part and an anchor extension. The first part attaches subsections or panels together providing an open envelope of a next subsequent section to be raised. The next subsequent section is then raised to a self standing position adjacent to a previously erected section. The integrated sequential fastener is then used to laterally slide next subsequent section to butt and join all vertical interface edges. The integrated sequential fastener therefore supports floor and roof subsections and is the assembler's means to bring the tongue and groove sections together and to hold the sections together permanently. The anchor extension sequential fastener part is attached to both male and female ground floor wall parts and to the structure's foundation sill.

The sequence fastener device itself also accomodates two different subsection configurations namely the isolated stemmed deck and the interface box stemmed deck. "Deck" refers to floor, sidewall and roof subsections.

The fastener device can also accomodate sections and subsections made of other materials. These would include wood, metal, fiberglass fabricated, particle, organic stem extruded or formed materials, such as concrete. The latter material is a viable material application for this type of construction.

Tongue and groove application at section interface is more adaptable for floor deck subsections, however, the tongue and groove configuration may extend to the entire section to section interface joined.

The horizontal "H" alignment and seal can be used on the exterior sidewall and roof subsections mainly. The elastometric rope would have the same application. Both the horizontal "H" and elastometric rope may need to be adhesively applied to the interface edge while the assembled vertical section lies on its side.

OBJECTIVES OF THE INVENTION

One objective is to provide an inexpensive vertical section fabricated structure that can be erected in a short time by experienced construction workers or by inexperienced layman with instructions in hand.

A further objective is to provide one fastening means that securely holds assembled subsections to be raised, secures them in place and anchors the building.

A further objective is to provide a fastening means to slide assembled vertical sections together into one unit.

A further object is to provide a fastening means to hold the units together for the lifetime of the structure.

A further objective is to provide a fastening means that can enable the disassembly of the structure.

A further objective is to provide a fastening means that can be reused to assemble the structure at a different location.

A further objective is to provide a fastening means that can routinely be adjusted for a certain section interface fit.

A further objective is to provide a vertical section building where service, guest, work and family circulation is efficient.

A further objective is to avoid a "tunnel type" home by providing window lighting and ground level door entrance at a midstructure lateral interface extension.

A further objective is to provide a family utility service center central within the building confines being close to the entrance or entrances of the building.

A further objective is to provide a prefabricated structural design that can utilize nearly all conventional commercially manufactured available materials.

A further objective is to provide a temporary or permanent structure that can easily be assembled and disassembled.

BRIEF DESCRIPTION OF THE DRAWINGS

FIG. 1 is an isometric view illustrating a vertical section building shell construction that has been completed.

FIG. 2 is an isometric view illustrating an unfinished vertical section building shell. An assembled vertical section is lying on its open envelope side. The roof end is readied to be raised 90° in the path of the construction line indicated. Section parts consist of a roof, sidewalls and floor subsections.

FIG. 9 is a side elevation view of a stemmed double T floor subsection.

FIG. 10 is a bottom plan view of FIG. 9.

FIG. 11 is an end view of FIGS. 9 and 10.

FIG. 12 is a side elevation view of a stemmed double T side wall subsection.

FIG. 12A is a view taken at EE in FIG. 12.

FIG. 13 is a bottom plan view of FIG. 12.

FIG. 14 is an end view of FIGS. 12 and 13.

FIG. 15 is a side elevation view of a stemmed double T roof subsection.

FIG. 16 is a bottom plan view of FIG. 15.

FIG. 17 is an end view of FIGS. 15 and 16.

Figures 3, 4, 5, 6, 6A, 7, 8, 12B, 18, 18A, 19, 20, 30A, 37, 38, 39, 40, 41:
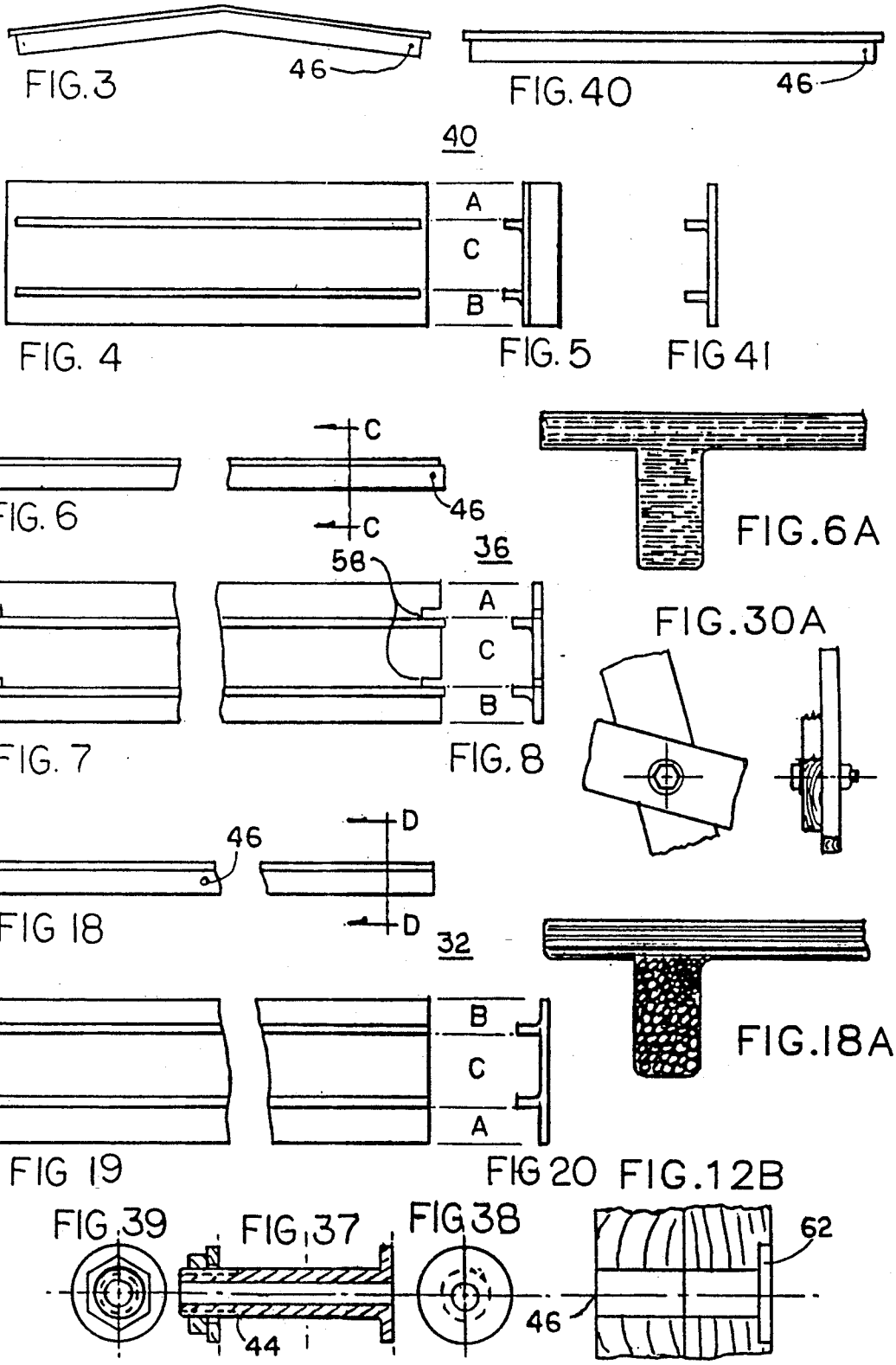
FIG. 3 is a side elevation view of a stemmed double T roof subsection part.
FIG. 4 is a bottom plan view of FIG. 3 and FIG. 40.
FIG. 5 is an end view of FIGS. 3 and 4.
FIG. 6 is a side elevation view of a stemmed double T subsection part.
FIG. 6A is a view taken at CC in FIG. 6.
FIG. 7 is a bottom plan view of FIG. 6.
FIG. 8 is an end view of FIGS. 6 and 7.
FIG. 12B is a view taken at GG in FIG. 12.
FIG. 18 is a side elevation view of a stemmed double T roof subsection.
FIG. 18A is a view taken at DD in FIG. 18.
FIG. 19 is a bottom plan view of FIG. 18.
FIG. 20 is an end view of FIGS. 18 and 19.
FIG. 30A comprises views of encircled areas in FIGS. 29 and 30.
FIG. 37 is a cross section view of the sequential female flanged interlock bolt.
FIG. 38 is an elevation view of flanged end of FIG. 37.
FIG. 39 is an elevation view of threaded end, nut and washer of FIG. 37.
FIG. 40 is a side elevation view of a straight extruded material roof subsection.
FIG. 41 is an end view of FIGS. 40 and 4.

View AA is a front and side elevation cross sectional cutaway view of a mid structure interface extension fastening means.

View BB is a cutaway cross sectional view of a elastometric rope seal assembly intermediate two section interfaces.

View CC is a cross section view of bonded together fiber particle parts sectional material.

View DD is a cross sectional view of bonded together stress oriented organic fiber and pulp stems.

View EE is an end view of fiberglass 56 section material incorporated with wood or metal structural members.

View F is a plan view of concrete composite materials cast into a sectional part.

View G is a cross section view of flat countersink and hole.

DETAILED DESCRIPTION OF PREFERRED EMBODIMENTS

FIGS. 1 and 2 show a floor, sidewall and roof of completed shell structure 10, the last section or segment 50 having been assembled at 20, and raised along path 28, to point 30, for sliding laterally in place and attached to the series 24 of previously erected sections. Next subsquent section 20, is made up of floor subsections 36, wall subsections 32, and a roof subsection 40. Section 20, is positioned a section width 22 away, on sills 14, and is raised 90° with roof 40, peak 26, being rotated to point 30. Building 24, is supported on the ground by pier blocks 12.

The top outer interface edge is at 34.

FIGS. 9, 10 and 11 show a fabricated floor subsection 36, with predrilled holes or apertures 46, in the stem structural members. Cutouts 58, are at all four corners of the sheet member of subsection 36.

FIGS. 12, 13 and 14 show a fabricated sidewall subsection or panel 32, with predrilled and countersunk holes drilled in both ends and in the center of the structural stems at 46. Cross section EE is shown in FIG. 12A. Cross section GG is depicted in FIG. 12B.

FIGS. 3, 4 and 5 show a molded stemmed deck roof subsection 40, with predrilled holes 46, at both ends of each stem.

FIGS. 40, 4 and 41 show an extruded stemmed deck roof subsection 40, with predrilled holes 46, at both ends of each stem.

FIGS. 6, 7 and 8 show a molded or extruded stemmed deck floor subsection 36, with two cutouts at both ends 58, to receive wall stem overlap at assembly. Predrilled holes 46, are at both ends of each stem. Cross section CC is shown in FIG. 6A. In all stemmed deck subassemblies, the stem structural member edge shares a common centerline with cutouts 58, wherein edge A plus B widths equals C width.

FIGS. 18, 19 and 20 show a wall subsection 32, molded or extruded, predrilled to receive fasteners for floors and roof subsection attachments. Holes or apertures are predrilled in both stems at opposite ends and in the center at 46. Cross section DD (FIG. 18A) shows sidewall end-for-end reversing which accommodates opposite wall offset stem locations of floor and roof stemmed deck assemblies. Therefore, only a one-part configuration sidewall is needed for both opposite side sidewalls.

FIGS. 37, 38 and 39 cross sectional views showing the female flanged interlock sleeve bolt 44 are to assemble subsections to make a section 20.

Figures 21, 22:
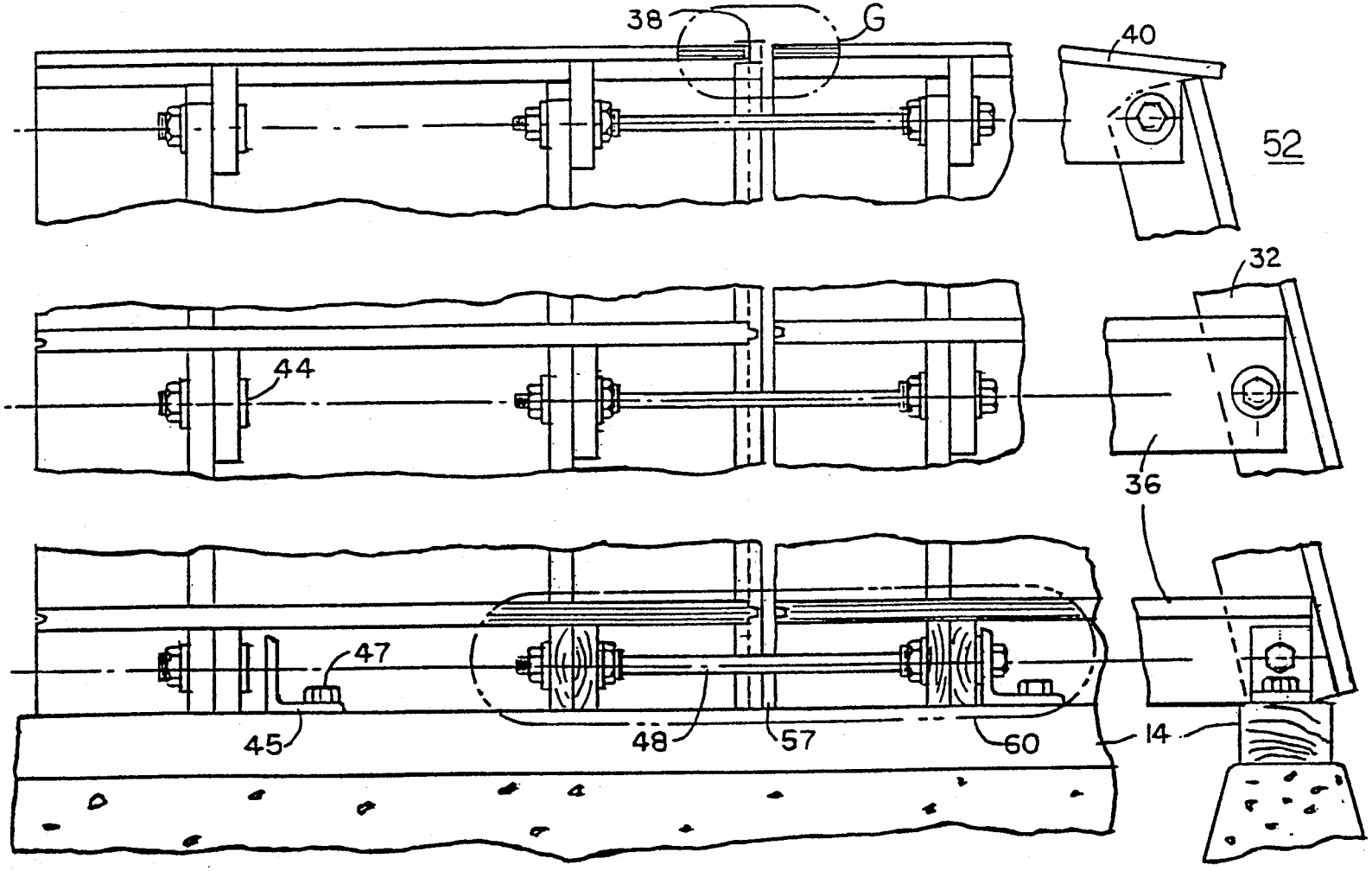
FIG. 21 is a front elevation view of stemmed double T sections assembly.
FIG. 22 is an inside elevation view of FIG. 21.

FIGS. 21 and 22 show fabricated section assembly with stemmed deck section configuration 52. View G shows "H" seal 38 intermediate interfaces to be joined on exterior section parts 40 and 32. Floor subsection parts are tongue and groove at interface.

Figures 23, 24:
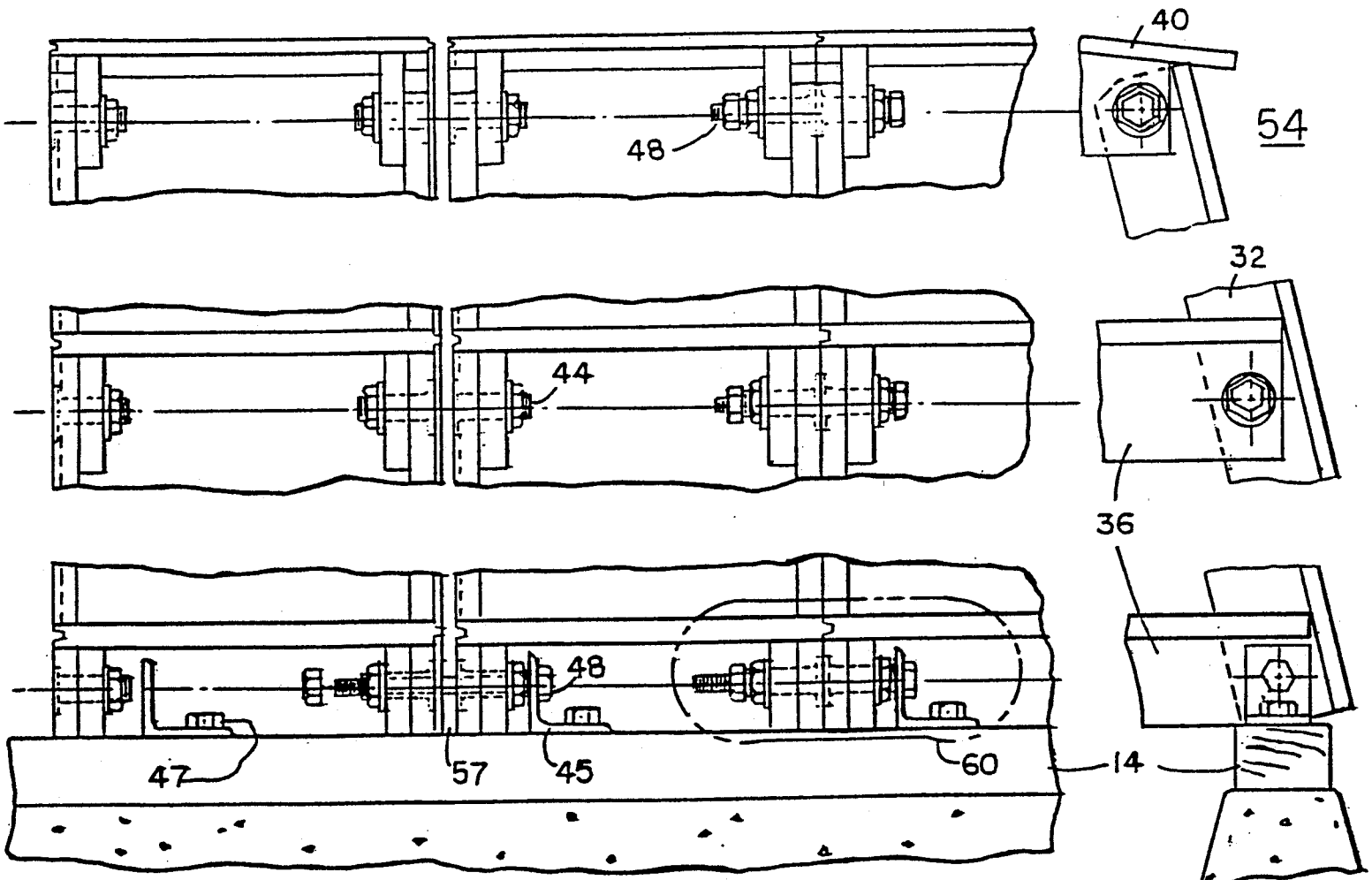
FIG. 23 is a front elevation view of stemmed double T sections assembly.
FIG. 24 is an inside elevation view of FIG. 23.

FIGS. 23 and 24 show a fabricated section assembly with box stem configuration. Tongue and groove interface configuration is shown contiguous all subsection parts of sections being joined. Slider draw bolt 48 and nut shown will bring next subsequent section or segment into contact with assembled sections at their interface 57.

Figures 25, 26:
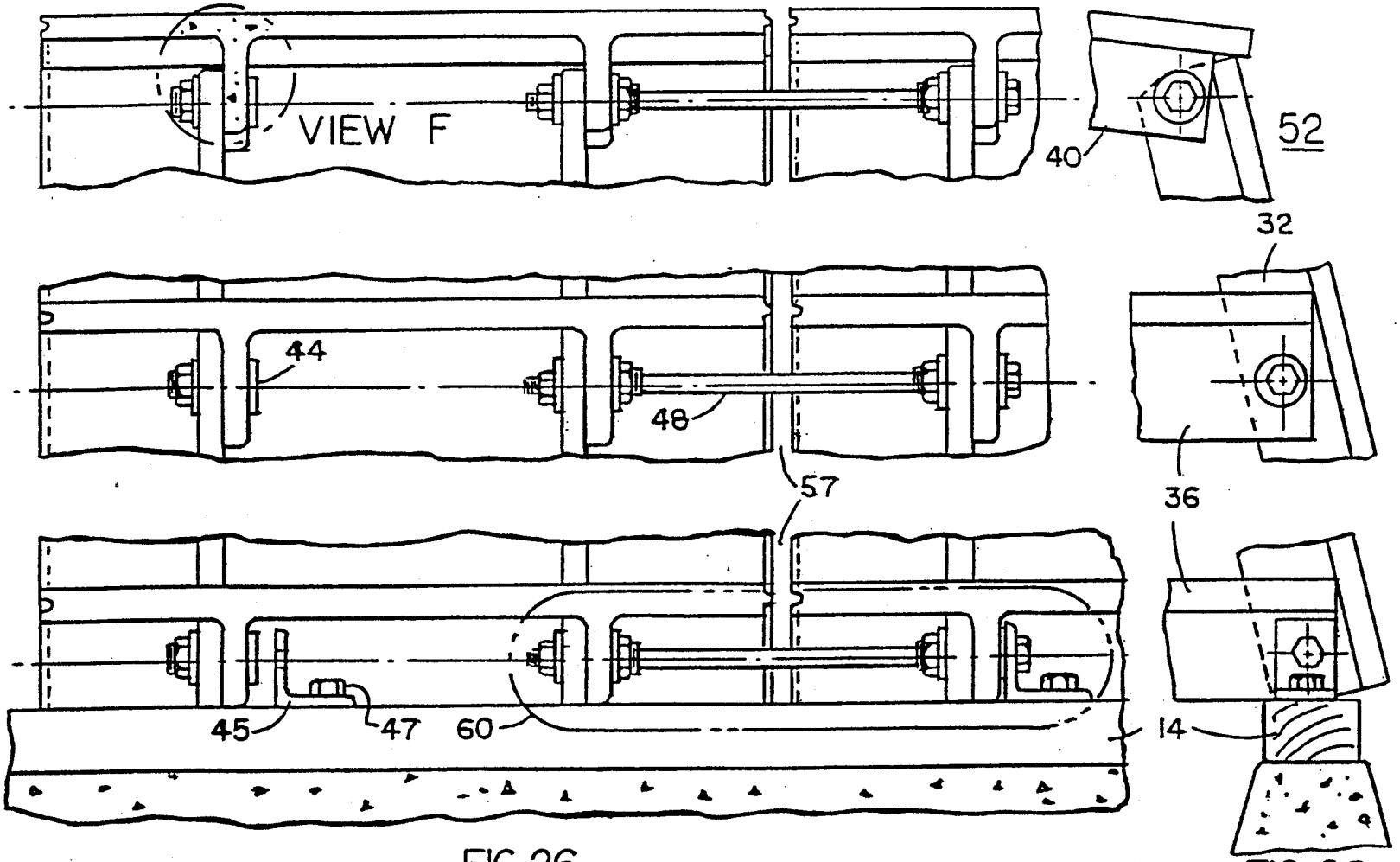
FIG. 25 is a front elevation view of stemmed double T section assembly.
FIG. 26 is an inside elevation view of FIG. 25.

FIGS. 25 and 26 show an extruded or poured stemmed deck section configuration. View F shows in this particular subsection concrete construction. A complete fastener assembly at 60 is shown sliding an isolated section into place.

Figures 27, 28:
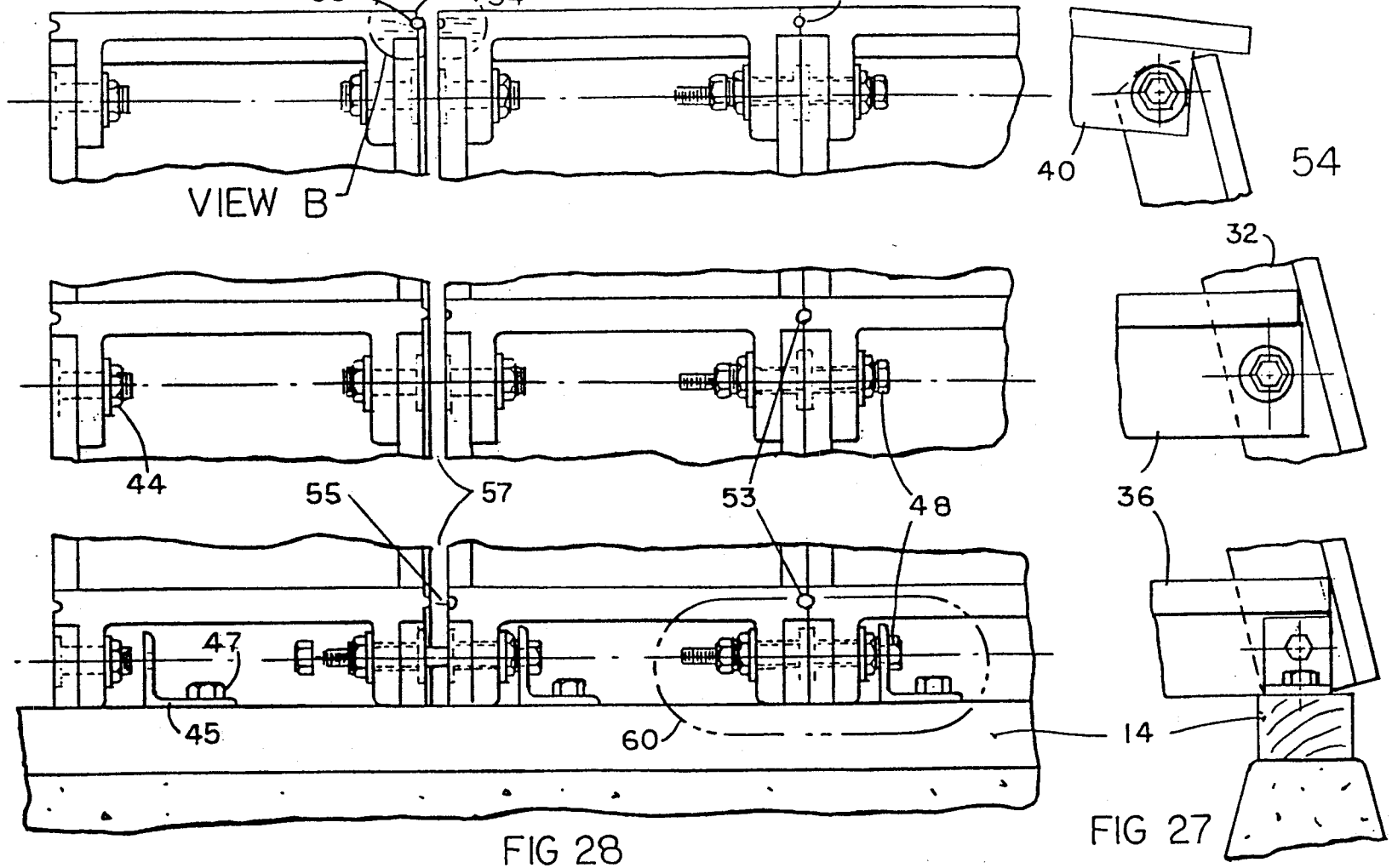
FIG. 27 is a front elevation view of stemmed double T sections assembly.
FIG. 28 is an inside elevation view of FIG. 27.
Figure 33:
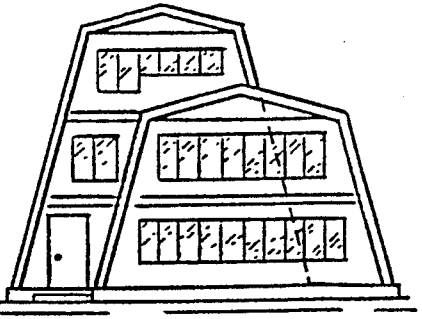
FIG. 33 is a front elevation view of a vertical section mid structure lateral and vertical three story interface extensions.
Figure 36:
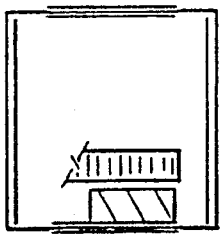
FIG. 36 is a third floor plan view of FIG. 33.

FIGS. 27 and 28 show an extruded or poured box stem 54, section configuration. View B shows the adhesively applied elastometric rope 53, in place 34, at the section interface of the exterior wall 32, and roof 40, subsection interface parts. Floor subsections 36 can be interface joined by elastometric rope 53, or with a tongue and groove 55 configuration.

Figure 30:
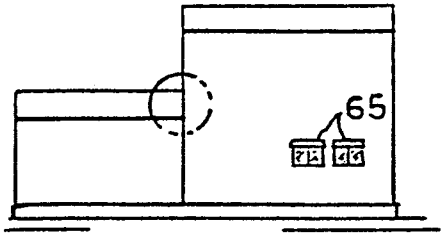
FIG. 30 is a side elevation view of FIG. 29.
Figure 29:
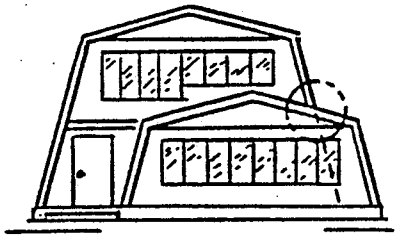
FIG. 29 is a front elevation view of a vertical section mid structure lateral and vertical interface extensions.
Figure 35:
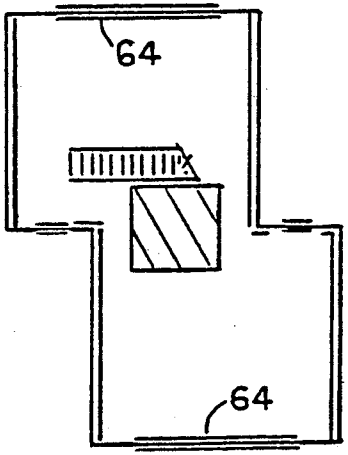
FIG. 35 is a second floor plan view of FIG. 33.
Figure 34:
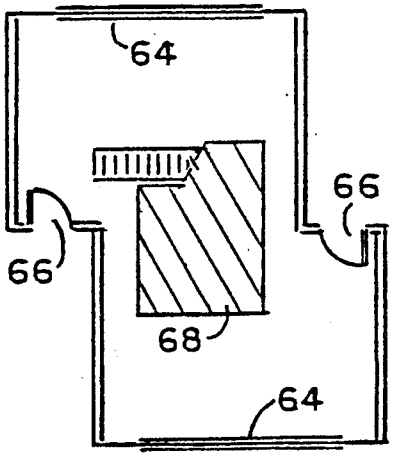
FIG. 34 is a first floor plan view of FIG. 33.
Figure 32:
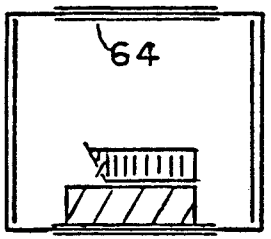
FIG. 32 is a second floor plan view of FIG. 29.
Figure 31:
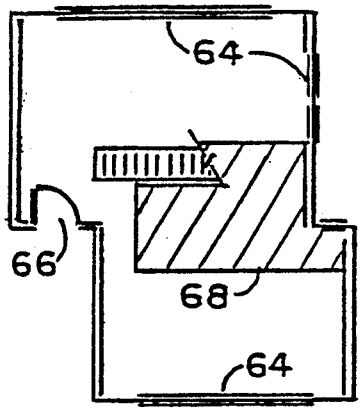
FIG. 31 is a first floor plan view of FIG. 29.

FIGS. 29 and 30 show an interrupted section wall one and two story house arrangement with a center structure main entrance 66. The main entrance is in close proximity to utility and stairs area 68, shown in FIGS. 31 and 32. Daylight penetration will fill the two room areas at both ends of the cottage. Dormer windows 65, are optional between the structural stems of prefabricated wall 36, subsections.

Shaded central utility area 68 contain bathrooms, clothes washer and dryer appliances, kitchen appliance area and stairs traffic area.

Prefabricated house plan analysis according to basic human element requirements is a logical balance of three areas, sleeping, living and work areas. Compactness is provided for circulation ease, yet each area is isolated from through-room traffic.

A multi-story dwelling that is heat efficient can have a great room or cathedral cealings offering many design variations. The home is not a monument to a certain generation but is structurally flexible to accomodate all generations.

FIGS. 33, 34, 35 and 36 show an interrupted section wall two and three story house arrangement with two center structure entrances at 66.

I claim:

1. A building structure comprising at least two segments secured together to form said structure, each segment including at least one substantially vertical member and an intersecting member extending at an angle to said first member, and a means for securing said members at a joint including apertures provided in each vertical and extending member at a said joint and a female fastener comprising a hollow tubular member passing through said apertures and clamping said vertical and intersecting members together, a female fastener of a first segment being alignable with a female fastener of a second segment, and a male fastener adapted to extend through the hollow tubes of aligned fasteners to secure said first and second segments together.

2. The building structure of claim 1 wherein said substantially vertical member is a wall subsection and said intersecting member is a floor subsection.

3. The structure of claim 1 wherein said substantially vertical member is a wall subsection and said intersecting member is a roof subsection.

4. The structure of claim 1 wherein said female fastener comprises a flanged threaded tube and wherein an end of one of said vertical and intersecting members is provided with a recessed aperture for receiving the flange of said tube in flush relationship.

* * * * *

UNITED STATES PATENT AND TRADEMARK OFFICE

CERTIFICATE OF CORRECTION

PATENT NO. : 5,177,914

DATED : January 12, 1993

INVENTOR(S) : Elwyn P. Hilmer

It is certified that error appears in the above-identified patent and that said Letters Patent is hereby corrected as shown below:

On the title page, in the ABSTRACT, line 19, before "avoids", delete "to".

Column 2, line 53, "object" should read --objective--.

Column 5, line 13, before "cross" insert --are--.

Column 5, line 14, after "bolt 44" delete "are".

Signed and Sealed this

Twenty-fifth Day of January, 1994

*Attest:*

Bruce Lehman

BRUCE LEHMAN

*Attesting Officer*

*Commissioner of Patents and Trademarks*